US010451015B2

(12) United States Patent
Yukishige et al.

(10) Patent No.: US 10,451,015 B2
(45) Date of Patent: Oct. 22, 2019

(54) DIESEL ENGINE

(71) Applicant: Yanmar Co., Ltd., Osaka-shi, Osaka-fu (JP)

(72) Inventors: Seiji Yukishige, Osaka (JP); Ryuichiro Murakami, Osaka (JP); Hiroyuki Nakagawa, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/764,081

(22) PCT Filed: Sep. 26, 2016

(86) PCT No.: PCT/JP2016/078229
§ 371 (c)(1),
(2) Date: Mar. 28, 2018

(87) PCT Pub. No.: WO2017/057252
PCT Pub. Date: Apr. 6, 2017

(65) Prior Publication Data

US 2018/0283335 A1 Oct. 4, 2018

(30) Foreign Application Priority Data

Sep. 30, 2015 (JP) ..... 2015-195400

(51) Int. Cl.
*F02M 59/10* (2006.01)
*F02M 39/02* (2006.01)
*F02N 19/00* (2010.01)

(52) U.S. Cl.
CPC ..... *F02M 59/102* (2013.01); *F02M 39/02* (2013.01); *F02M 59/10* (2013.01); *F02N 19/00* (2013.01)

(58) Field of Classification Search
CPC ..... F02M 59/102; F02M 59/10; F02M 39/02; F02N 19/00

(Continued)

(56) References Cited

U.S. PATENT DOCUMENTS 4,257,365 A * 3/1981 Noguchi ..... F02B 25/08 123/51 B
6,230,689 B1 5/2001 Tengroth et al.
(Continued)

FOREIGN PATENT DOCUMENTS

DE 637034 C2 10/1936
EP 1691066 A1 8/2006
(Continued)

OTHER PUBLICATIONS

International Search Report dated Oct. 18, 2016 issued in corresponding PCT Application PCT/JP2016/078229 cites the patents documents above.

(Continued)

*Primary Examiner* — Hai H Huynh
*Assistant Examiner* — Gonzalo Laguarda
(74) *Attorney, Agent, or Firm* — Norton Rose Fulbright US LLP

(57) ABSTRACT

A diesel engine including: a cam shaft driven by a crankshaft, a fuel injection pump driving cam provided on the cam shaft and configured to drive a fuel injection pump, and an intake cam provided on the cam shaft and configured to drive an intake valve. The fuel injection pump driving cam has a maximum radius portion, a minimum radius portion, an intermediate portion having a radius smaller than that of the maximum radius portion and larger than that of the minimum radius portion, and a slant portion where the intermediate portion shifts to the minimum radius portion in a reverse rotation direction of the driving cam. The position where the intermediate portion shifts to the slant portion begins after the intake valve is opened to an extent corresponding to at least half of a maximum lift of the intake valve.

11 Claims, 8 Drawing Sheets

(58) Field of Classification Search
USPC ..... 123/507, 508
See application file for complete search history.

(56) References Cited

U.S. PATENT DOCUMENTS

| | | | | |
|---|---|---|---|---|
| 7,441,531 | B2 * | 10/2008 | Shiota | F01L 1/08 123/185.13 |
| 2007/0272199 | A1 | 11/2007 | Shiota et al. | |
| 2015/0226169 | A1 * | 8/2015 | Williams | F02M 63/027 123/445 |

FOREIGN PATENT DOCUMENTS

| | | | |
|---|---|---|---|
| GB | 2112871 | A | 7/1983 |
| JP | 47-033290 | B1 | 8/1972 |
| JP | 52-061627 | A | 5/1977 |
| JP | 52-084317 | A | 7/1977 |
| JP | 1991-027876 | U | 3/1991 |
| JP | H08-028399 | A | 1/1996 |
| JP | 2001-515560 | A | 9/2001 |
| JP | 2005-133581 | A | 5/2005 |

OTHER PUBLICATIONS

Extended European search report dated Jul. 23, 2018 issued in corresponding EP Application 16851423.0 cites the patent documents above.

* cited by examiner

DIESEL ENGINE

CROSS REFERENCES TO RELATED APPLICATIONS

This application is a national stage application pursuant to 35 U.S.C. § 371 of International Application No. PCT/JP2016/078229, filed on Sep. 26, 2016, which claims priority under 35 U.S.C. § 119 to Japanese Patent Application No. 2015-195400, filed on Sep. 30, 2015, the disclosures of which are hereby incorporated by reference in their entireties.

TECHNICAL FIELD

The present invention relates to a technique of a diesel engine.

BACKGROUND ART

A technique for preventing a reverse rotation at a time when a diesel engine starts is conventionally known (for example, Patent Literature 1 (PTL 1)). In a single-cylinder diesel engine, however, a reverse rotation may occur not only at a time of starting but also during operation. For example, in a case where a flywheel returns (rotates in a reverse direction) due to an inertial force while a diesel engine is operating and a fuel is injected timely at that time, the reverse rotation may continue.

CITATION LIST

Patent Literature

PTL 1: Japanese Patent Application Laid-Open No. 2005-133581

SUMMARY OF INVENTION

Technical Problem

An object of the present invention is to provide a diesel engine capable of preventing a reverse rotation from continuing if the reverse rotation occurs during operation.

Solution to Problem

A problem to be solved by the present invention is as described above, and means for solving the problem will now be described.

In a first aspect, a diesel engine includes: a cam shaft that is driven by a crankshaft; a fuel injection pump driving cam that is provided on the cam shaft and configured to drive a fuel injection pump, the fuel injection pump driving cam having a maximum radius portion, a minimum radius portion, an intermediate portion having a radius smaller than that of the maximum radius portion and larger than that of the minimum radius portion, and a slant portion where the intermediate portion shifts to the minimum radius portion, wherein the intermediate portion, the slant portion, and the minimum radius portion are formed in sequence along a reverse rotation direction; and an intake cam that is provided on the cam shaft and configured to drive an intake valve, the fuel injection pump driving cam being formed such that a position where the intermediate portion shifts to the slant portion begins after the intake valve is opened to an extent corresponding to at least half of a maximum lift of the intake valve.

A second aspect is the diesel engine of the first aspect, wherein the fuel injection pump driving cam has an upper portion having a radius smaller than that of the maximum radius portion and larger than that of the intermediate portion, and the intermediate portion, the upper portion, and the slant portion are formed in sequence along the reverse rotation direction.

Advantageous Effects of Invention

The diesel engine of the present invention can prevent a reverse rotation from continuing if the reverse rotation occurs during operation.

DESCRIPTION OF EMBODIMENTS

A diesel engine 1 will be described with FIG. 1 to FIG. 3.

Figure 1:
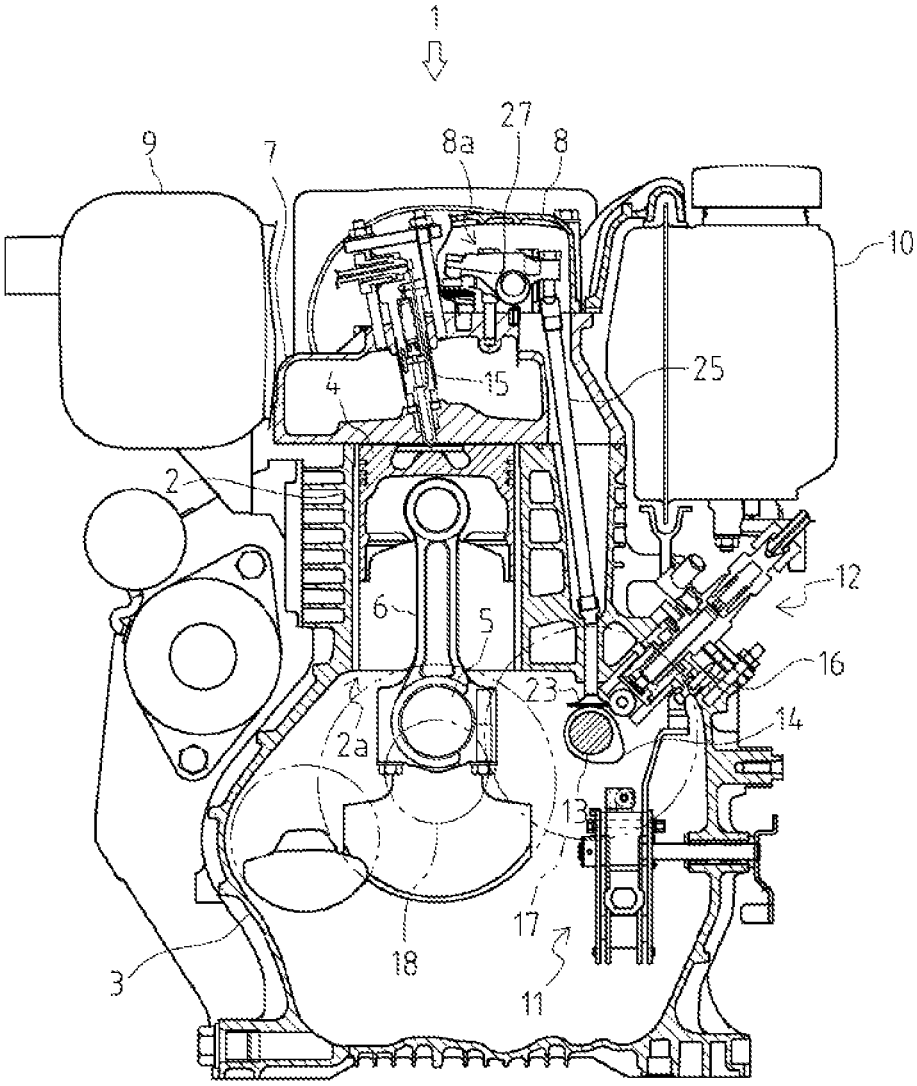
FIG. 1 A partial cross-sectional front view showing a configuration of a diesel engine.
Figure 2:
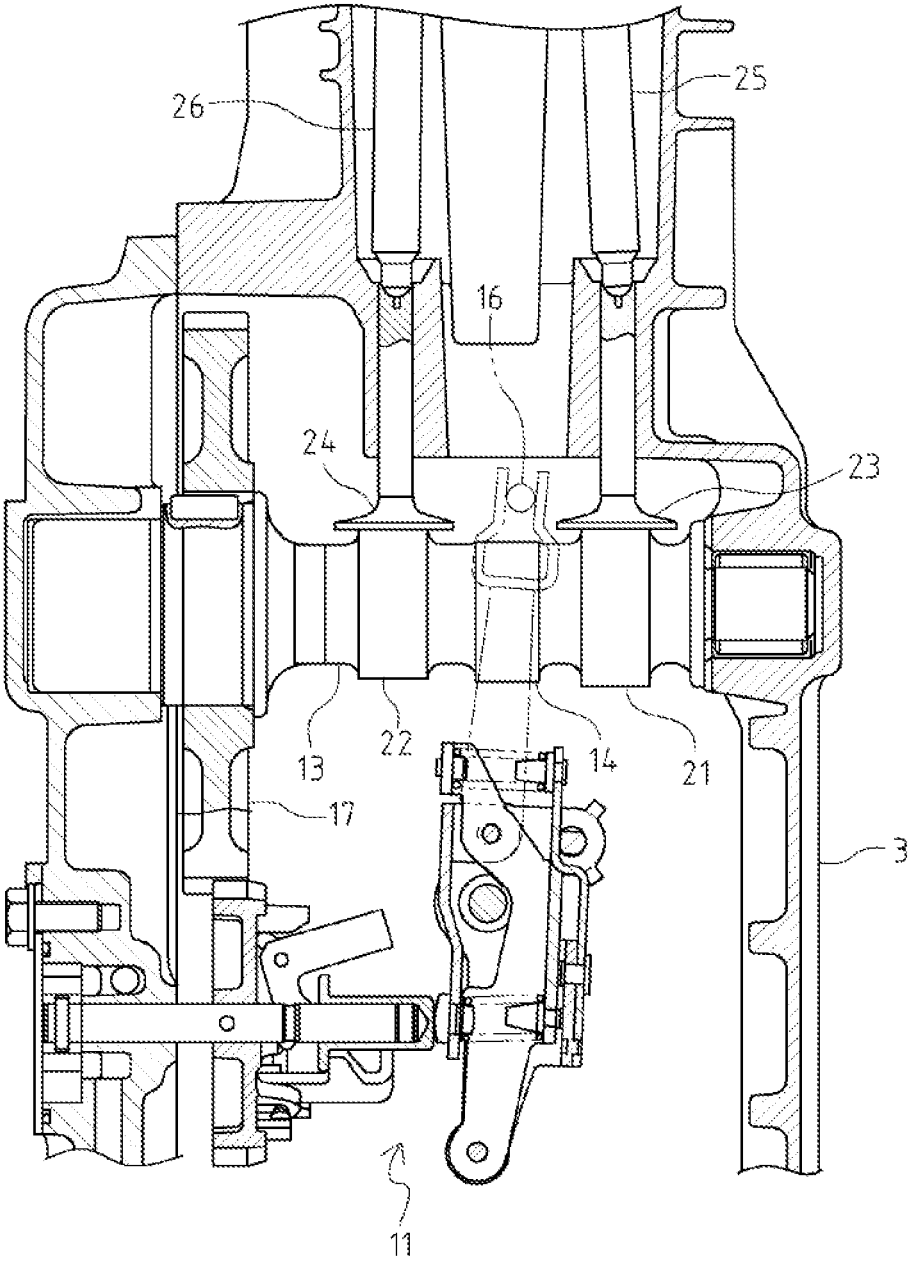
FIG. 2 A partial cross-sectional side view showing a configuration of a lower part of the diesel engine.
Figure 3:
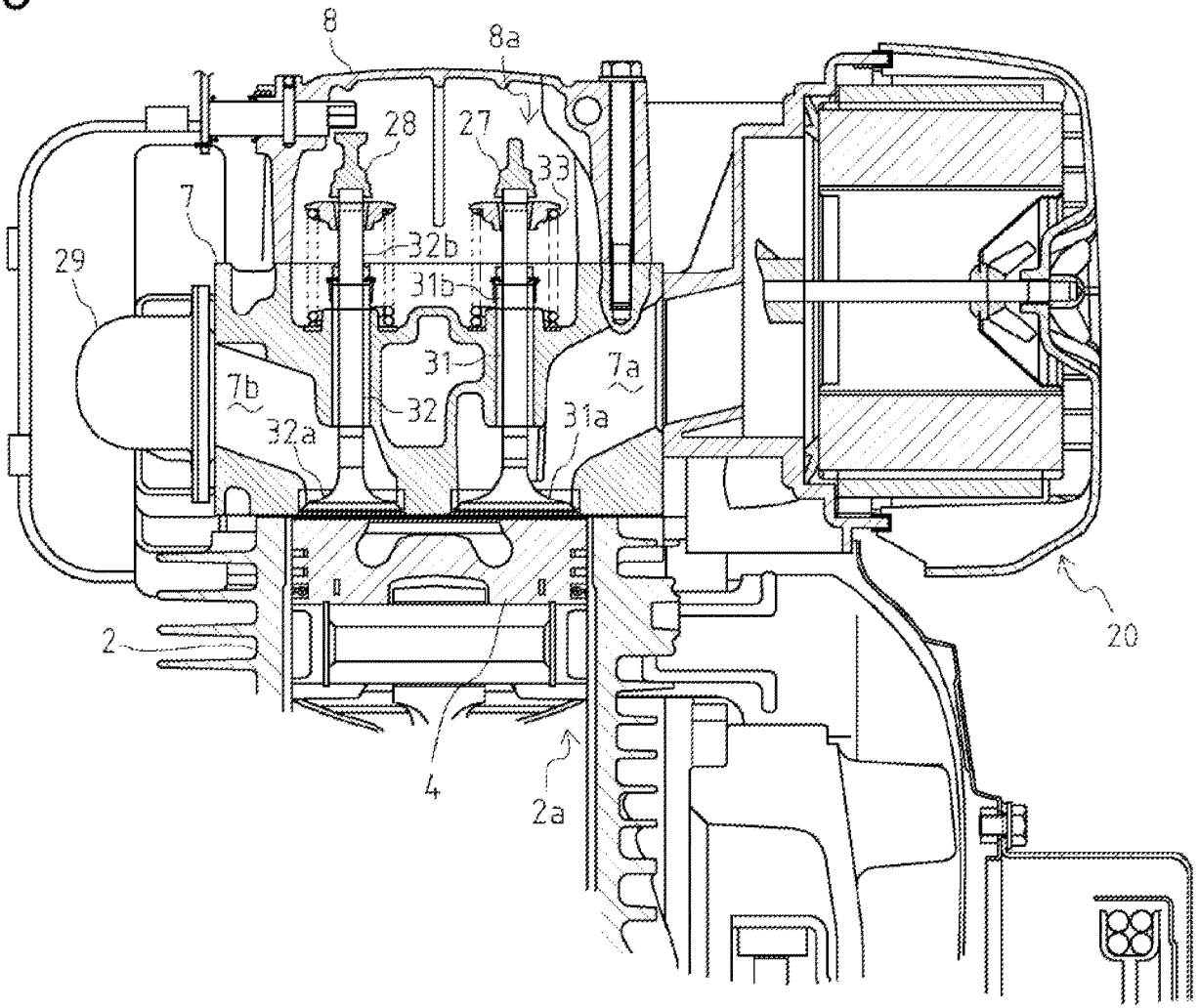
FIG. 3 A partial cross-sectional side view showing a configuration of an upper part of the diesel engine.

In FIG. 1, a configuration of the diesel engine 1 is shown in a partial cross-sectional front view; in FIG. 2, a configuration of a lower part of the diesel engine 1 is shown in a partial cross-sectional side view; and in FIG. 3, a configuration of an upper part of the diesel engine 1 is shown in a partial cross-sectional side view.

The diesel engine 1 is an embodiment of the diesel engine of the present invention. The diesel engine 1 of this embodiment is an air-cooled diesel engine of single-cylinder type.

A main body of the diesel engine 1 includes a cylinder block 2 in an upper part and a crank case 3 in a lower part. In the center of the cylinder block 2, a cylinder 2*a* is provided in the vertical direction (up-down direction). The cylinder 2*a* has a piston 4 stored therein.

A cylinder head 7 is arranged above the cylinder block 2. A hood cover 8 is arranged above the cylinder head 7. The inside of the hood cover 8 is formed as a rocker arm chamber 8*a*, in which an intake rocker arm 27, an exhaust rocker arm 28, an upper end portion of an intake valve 31, an upper end portion of an exhaust valve 32, an upper end portion of an intake push rod 25, and an upper end portion of an exhaust push rod 26 are provided (see FIG. 3).

A muffler 9 is arranged on one side (in FIG. 1, left side) of the hood cover 8 above the diesel engine 1. A fuel tank 10 is arranged on the other side (in FIG. 1, right side) of the hood cover 8.

A crankshaft 5 is pivotally supported on the crank case 3. The crankshaft 5 is coupled to the piston 4 by a connecting rod 6. In the crank case 3, a balance weight and a governor device 11 are arranged. Above the governor device 11, a fuel injection pump 12 and a cam shaft 13 are arranged.

The cam shaft 13 is pivotally supported on the crank case 3 so as to extend in parallel to the crankshaft 5. A cam gear 17 is fixed to one end of the cam shaft 13. The cam gear 17 is configured to be meshed with a gear 18 which is fixed to one end of the crankshaft 5 so that a driving force can be transmitted from the crankshaft 5 to the cam shaft 13 through the gear 18 and the cam gear 17.

An intake cam 21 and an exhaust cam 22 are provided at predetermined intervals in a middle portion of the cam shaft 13. A fuel injection pump driving cam 14 is provided between the intake cam 21 and the exhaust cam 22.

The intake cam 21 abuts against a tappet 23. To the tappet 23, a lower end of the intake push rod 25 is coupled. An upper end of the intake push rod 25 extends out into the rocker arm chamber 8*a* which is formed inside the hood cover 8, through a rod hole which is opened vertically in the cylinder block 2 and the cylinder head 7. The upper end of the intake push rod 25 abuts against a lower end of the intake rocker arm 27 on one side, and an upper end of the intake valve 31 abuts against a lower end of the intake rocker arm 27 on the other side.

The intake valve 31, which is composed of a valve head 31*a* in a lower end portion and a valve stem 31*b* in a body portion, is arranged above the piston 4. The valve head 31*a*, which is arranged such that it can be seated on or apart from a valve seat formed on a lower surface of the cylinder head 7, is able to allow or block communication between an intake port 7*a* formed in the cylinder head 7 and a combustion chamber of a cylinder 2*a* provided in the cylinder block 2. The intake port 7*a* is in communication with an air cleaner 20 which is provided on one side surface (rear surface) of the cylinder head 7.

The valve stem 31*b* extends upward through the cylinder head 7, and protrudes toward the hood cover 8 in a slidable manner, the valve stem 31*b* having its upper end abutting against the intake rocker arm 27. In the rocker arm chamber 8*a*, a spring 33 is fitted onto the valve stem 31*b*, and the spring 33 biases the valve head 31*a* such that the valve head 31*a* slides upward to close the intake valve 31.

The exhaust cam 22 abuts against a tappet 24. To the tappet 23, the lower end of the intake push rod 25 is coupled. To the tappet 24, a lower end of the exhaust push rod 26 is coupled.

An upper end of the exhaust push rod 26 extends out into the rocker arm chamber 8*a* which is formed inside the hood cover 8, through a rod hole which is opened vertically in the cylinder block 2 and the cylinder head 7. The upper end of the exhaust push rod 26 abuts against a lower end of the exhaust rocker arm 28 on one side, and an upper end of the exhaust valve 32 abuts against a lower end of the exhaust rocker arm 28 on the other side.

The exhaust valve 32, which is composed of a valve head 32*a* in a lower end portion and a valve stem 32*b* in a body portion, is arranged above the piston 4. The valve head 32*a*, which is arranged such that it can be seated on or apart from a valve seat formed on the lower surface of the cylinder head 7, is able to allow or block communication between an exhaust port 7*b* formed in the cylinder head 7 and the combustion chamber of the cylinder 2*a* provided in the cylinder block 2. The exhaust port 7*b* is in communication with the muffler 9 through an exhaust manifold 29.

The valve stem 32*b* extends upward through the cylinder head 7, and protrudes toward the hood cover 8 in a slidable manner, the valve stem 32*b* having its upper end abutting against the exhaust rocker arm 28. In the rocker arm chamber 8*a*, a spring 33 is fitted onto the valve stem 32*b*, and the spring 33 biases the valve head 32*a* such that the valve head 32*a* slides upward to close the exhaust valve 32.

A fuel injection nozzle 15 is arranged between the intake valve 31 and the exhaust valve 32. The fuel injection nozzle 15 protrudes downward through the cylinder head 7 with a distal end (ejecting part) thereof located above the center of the cylinder 2*a*, so as to inject a fuel supplied by the fuel injection pump 12 into the cylinder 2*a*.

In the diesel engine 1 having such a configuration, rotational movement of the crankshaft 5 causes rotational movement of the cam shaft 13 via the gear 18 and the cam gear 17, and the rotation of the cam shaft 13 causes the intake cam 21 to raise or lower the tappet 23 and causes the exhaust cam 22 to raise or lower the tappet 24.

As the tappet 23 is raised or lowered, the intake valve 31 slides up or down through the intake push rod 25 coupled to the tappet 23 and the intake rocker arm 27, and thus the intake valve 31 is opened or closed. As the tappet 24 is raised or lowered, the exhaust valve 32 slides up or down through the exhaust push rod 26 coupled to the tappet 24 and the exhaust rocker arm 28, and thus the exhaust valve 32 is opened or closed. That is, opening and closing of the intake valve 31 and the exhaust valve 32 is performed in conjunction with rotation of the intake cam 21 and the exhaust cam 22 of the cam shaft 13.

The fuel injection pump 12 will be described with FIG. 4.

Figure 4:
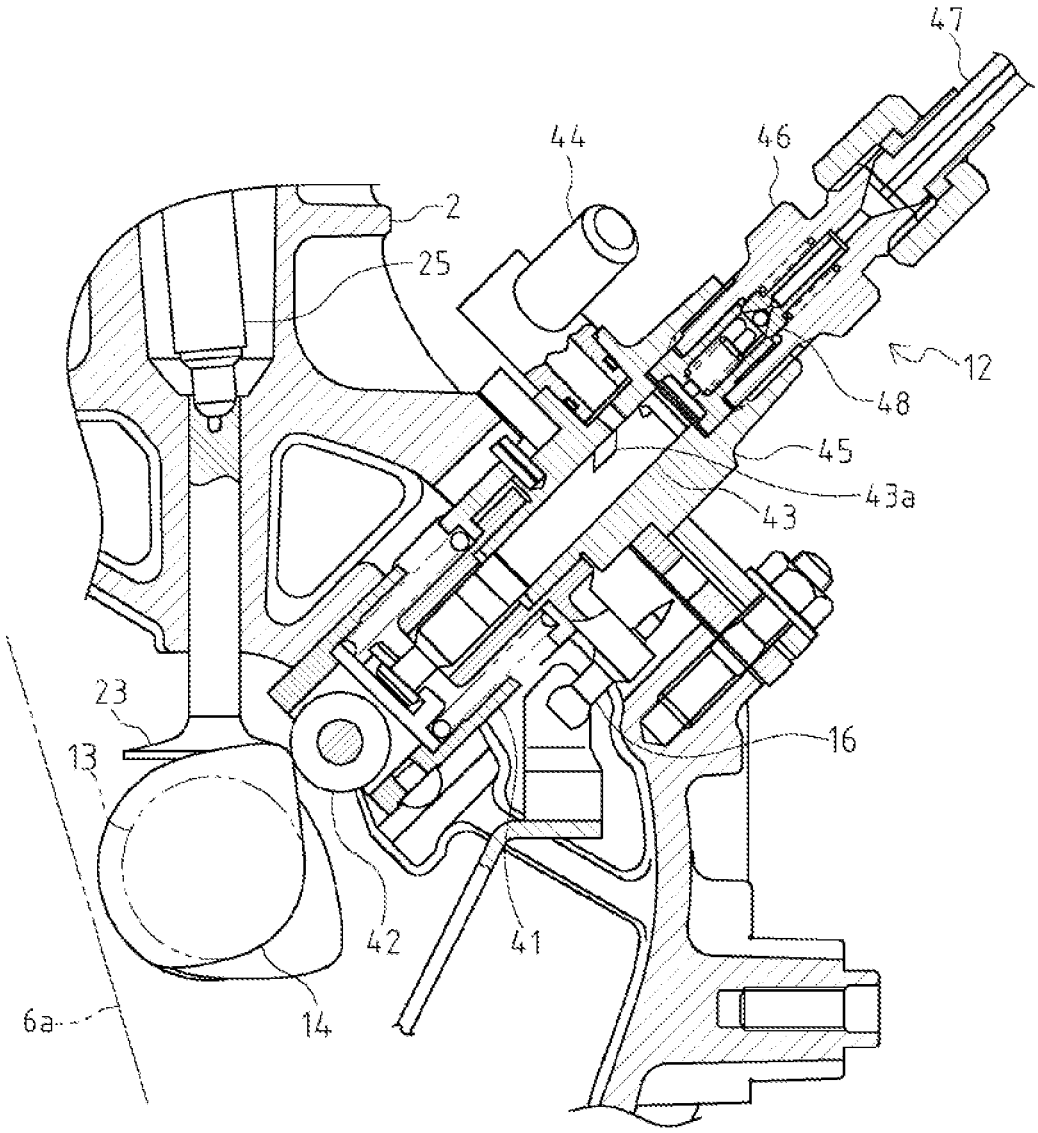
FIG. 4 A partial cross-sectional front view showing a configuration of a fuel injection pump.

In FIG. 4, a configuration of the fuel injection pump 12 is schematically shown in a partial cross-sectional view.

The fuel injection pump 12 as well as the cam shaft 13 is disposed above the governor device 11 which is arranged in the crank case 3. In the fuel injection pump 12, a roller 42 pivotally supported on the tappet 41 abuts against the fuel injection pump driving cam 14 which is provided between the intake cam 21 and the exhaust cam 22 of the cam shaft 13, and rotation of the fuel injection pump driving cam 14 causes a plunger 43 to slide reciprocably via the roller 42 and the tappet 41, so that a fuel of the fuel tank 10 is sucked from a sucking part 44 into a plunger barrel 45.

In the fuel injection pump 12 having such a configuration, further rotation of the fuel injection pump driving cam 14 raises the roller 42, and raises the plunger 43 via the roller 42 and the tappet 41 to compress a fuel in the plunger barrel 45, which opens an outlet valve 48 so that a predetermined amount of fuel is supplied from the ejecting part 46 to the fuel injection nozzle 15 through a high-pressure tube 47 at a predetermined timing.

The amount of fuel injected from the fuel injection nozzle 15 is adjustable by changing the stroke of the plunger 43 by rotationally moving a control lever 16 of the fuel injection pump 12 by using the governor device 11.

A configuration of the fuel injection pump driving cam 14 will be described with FIG. 5.

Figure 5:
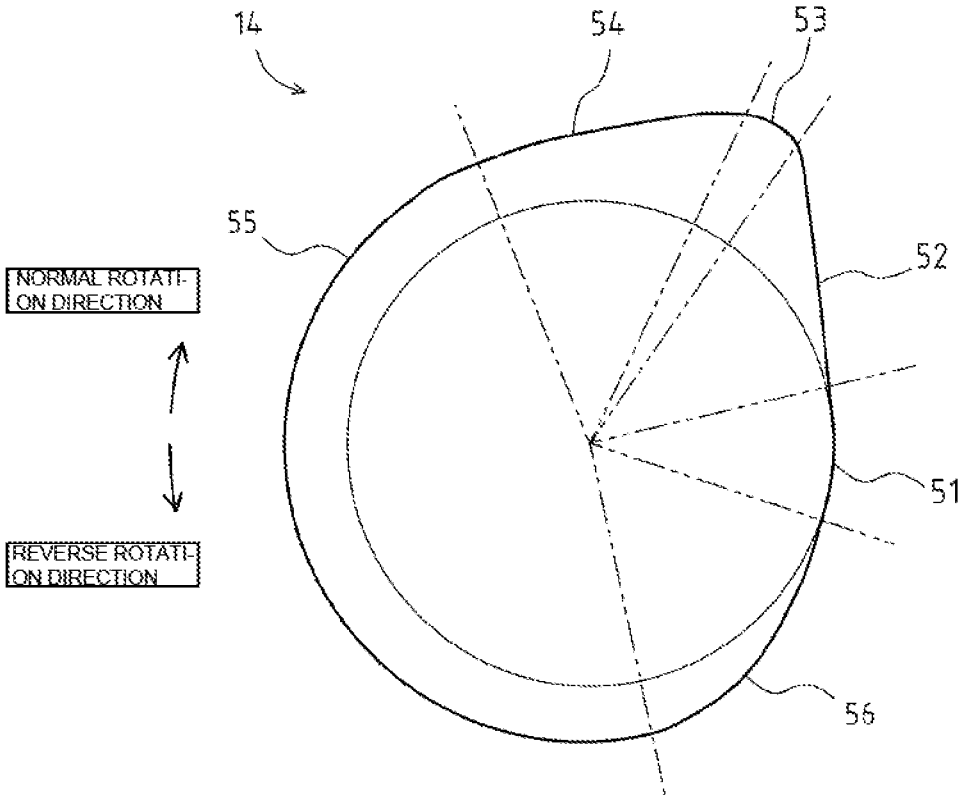
FIG. 5 A front view showing a configuration of a fuel injection pump driving cam.

In FIG. 5, the fuel injection pump driving cam 14 is schematically shown in a front view. The two-dot chain lines indicate boundaries of portions.

The fuel injection pump driving cam 14 is configured such that its radius varies in accordance with reciprocation of the piston 4 and the rotation angle of the crankshaft 5. The fuel injection pump driving cam 14 has a minimum radius portion 51, a slant portion 52, a maximum radius portion 53, a slant portion 54, an intermediate portion 55, a slant portion 56, and a minimum radius portion 51, which are arranged along a reverse rotation direction and which have different radii.

The minimum radius portion 51 is a portion having the minimum radius in the fuel injection pump driving cam 14. The maximum radius portion 53 is a portion having the maximum radius in the fuel injection pump driving cam 14. The intermediate portion 55 is a portion having a radius smaller than that of the maximum radius portion 53 and larger than that of the minimum radius portion 51.

The slant portion 52 is a portion where the minimum radius portion 51 shifts to the maximum radius portion 53 along the reverse rotation direction. The slant portion 54 is a portion where the maximum radius portion 53 shifts to the intermediate portion 55 along the reverse rotation direction. The slant portion 56 is a portion where the intermediate portion 55 shifts to the minimum radius portion 51 along the reverse rotation direction.

Functions of the fuel injection pump driving cam 14 will be described with FIG. 6.

Figure 6:
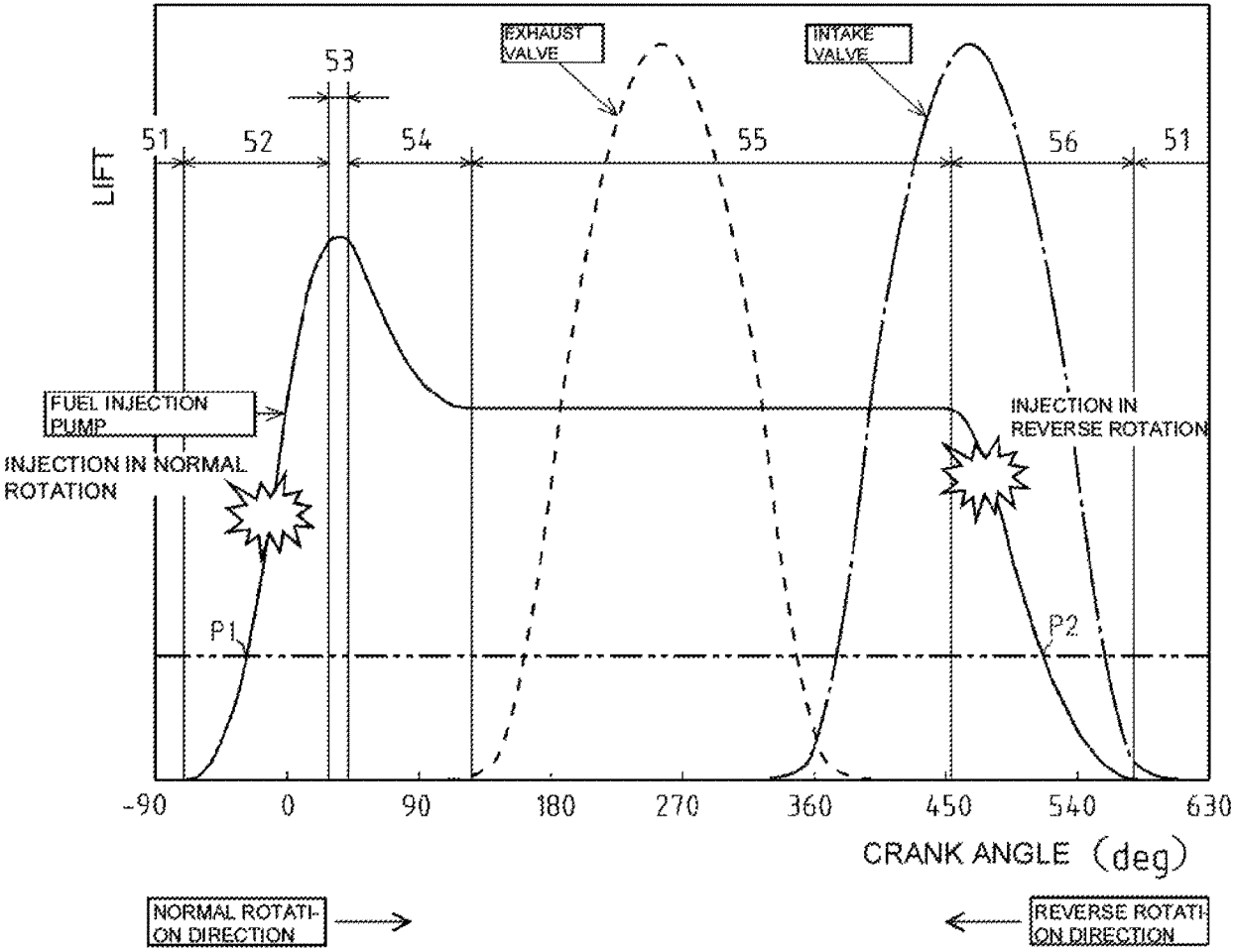
FIG. 6 A graph showing functions of the fuel injection pump driving cam.

In FIG. 6, functions of the fuel injection pump driving cam 14 are schematically shown as a graph in which the horizontal axis represents a crank angle and the vertical axis represents a lift. In FIG. 6, the solid line indicates a fuel cam lift; the broken line indicates an exhaust valve lift; the one-dot chain line indicates an intake valve lift; and the two-dot chain line indicates a timing of fuel pumping.

First, a function of the fuel injection pump driving cam 14 at a time of normal rotation (in the direction from left to right in FIG. 6) will be described. In a stage where the roller 42 abuts against the minimum radius portion 51, the fuel cam lift is at a minimum position, which is a position where the plunger 43 of the fuel injection pump 12 extends to the maximum (non-compression position). In a stage where the roller 42 abuts against the slant portion 52, the fuel is injected at a predetermined crank angle. More specifically, fuel pumping is started from the position of a point P1 on the two-dot chain line of FIG. 6, and the fuel is injected after the pumped fuel reaches a nozzle-opening valve pressure. That is, a timing of fuel injection is after the point P1 which is a timing of fuel pumping, and thus the timing of fuel pumping and the timing of fuel injection are different from each other.

Then, in a stage where the roller 42 abuts against the maximum radius portion 53, the fuel cam lift is at a maximum position, which is a position where the plunger 43 of the fuel injection pump 12 retracts to the maximum (compressed position). Then, in a stage where the roller 42 abuts against the intermediate portion 55, an open/close operation of the exhaust valve 32 is performed, and the intake valve 31 starts to open.

Then, in a stage where the roller 42 abuts against a position of shifting from the intermediate portion 55 to the slant portion 56, the intake valve 31 is opened to an extent corresponding to at least substantially half of the full open lift of the intake valve 31. In this embodiment, in the stage where the roller 42 abuts against the position of shifting from the intermediate portion 55 to the slant portion 56, the intake valve 31 is in a substantially full-open state. In a stage where the roller 42 abuts against a position of shifting from the slant portion 56 to the minimum radius portion 51, the intake valve 31 is in a completely-closed state.

In other words, the fuel injection pump driving cam 14 is formed such that the position of shifting from the intermediate portion 55 to the slant portion 56 begins after the intake valve 31 is opened to an extent corresponding to at least half of the maximum lift of the intake valve 31.

Next, a function of the fuel injection pump driving cam 14 at a time of reverse rotation (in the direction from right to left in FIG. 6) will be described. In a stage where the roller 42 abuts against the minimum radius portion 51, the plunger 43 of the fuel injection pump 12 extends to the maximum (non-compression position). In a stage where the roller 42 abuts against the slant portion 56, the fuel is injected at a predetermined crank angle. As shown in FIG. 6, a timing of fuel injection in reverse rotation is different from the timing of fuel injection in normal rotation. The timing of fuel injection in normal rotation and the timing of fuel injection in reverse rotation are different from each other in that the timing in reverse rotation is later than the timing in normal rotation relative to a point P2 of the timing of fuel pumping.

Simultaneously with this, in a stage where the roller 42 abuts against the slant portion 56, the intake valve 31 is in a sufficiently-opened state. Therefore, the injected fuel is discharged from the intake port 7*a*, and an amount of fuel necessary for combustion cannot be ensured in the cylinder 2*a*, so that no combustion occurs.

Effects of the diesel engine 1 will be described.

Use of the fuel injection pump driving cam 14 enables the diesel engine 1 to prevent a reverse rotation from continuing if the reverse rotation occurs during operation.

A configuration of a fuel injection pump driving cam 74 will be described with FIG. 7.

Figure 7:
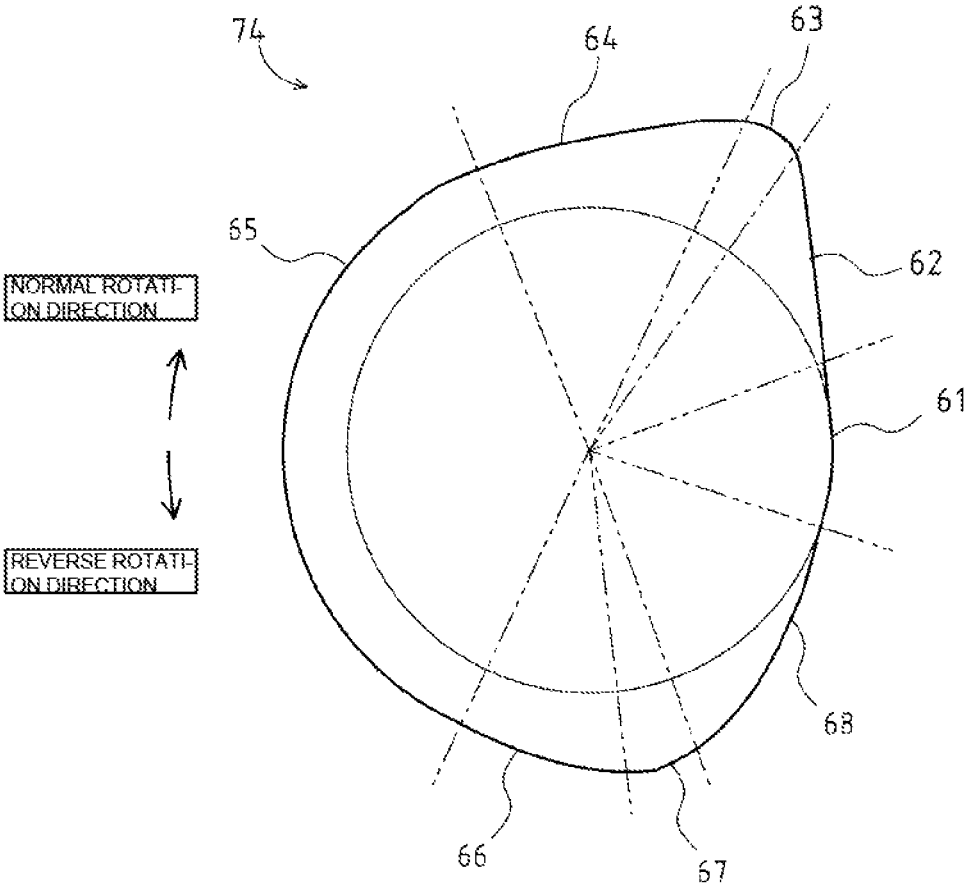
FIG. 7 A front view showing a configuration of another fuel injection pump driving cam.

In FIG. 7, the fuel injection pump driving cam 74 is schematically shown in a front view. The two-dot chain lines indicate boundaries of portions.

The fuel injection pump driving cam 74 is configured such that its radius varies in accordance with reciprocation of the piston 4 and the rotation angle of the crankshaft 5. The fuel injection pump driving cam 74 has a minimum radius portion 61, a slant portion 62, a maximum radius portion 63, a slant portion 64, an intermediate portion 65, a slant portion 66, an upper portion 67, a slant portion 68, and the minimum radius portion 61 which are arranged in this order along the reverse rotation direction and which have different radii.

The minimum radius portion 61 is a portion having the minimum radius in the fuel injection pump driving cam 74. The maximum radius portion 63 is a portion having the maximum radius in the fuel injection pump driving cam 74. The intermediate portion 65 is a portion having a radius smaller than that of the maximum radius portion 63 and larger than that of the minimum radius portion 61.

The slant portion 62 is a portion where the minimum radius portion 61 shifts to the maximum radius portion 63 along the reverse rotation direction. The slant portion 64 is a portion where the maximum radius portion 63 shifts to the intermediate portion 65 along the reverse rotation direction. The slant portion 66 is a portion where the intermediate portion 65 shifts to the upper portion 67 along the reverse rotation direction. The upper portion 67 is a portion having a radius smaller than that of the maximum radius portion 63 and larger than that of the intermediate portion 65.

Functions of the fuel injection pump driving cam 74 will be described with FIG. 8.

Figure 8:
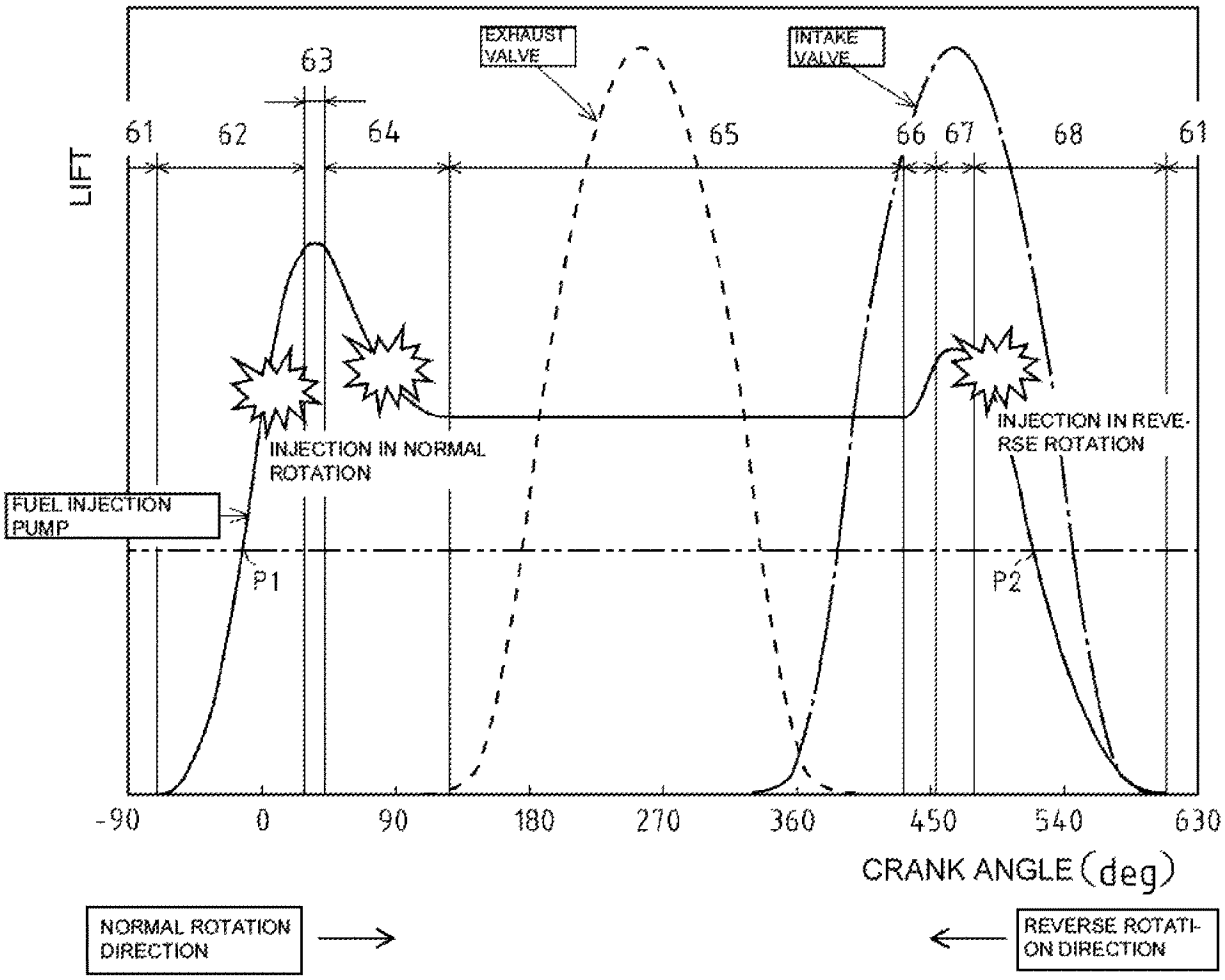
FIG. 8 A graph showing functions of another fuel injection pump driving cam.

In FIG. 8, functions of the fuel injection pump driving cam 74 are schematically shown as a graph in which the horizontal axis represents a crank angle and the vertical axis represents a lift. In FIG. 8, the solid line indicates a fuel cam lift; the broken line indicates an exhaust valve lift; the one-dot chain line indicates an intake valve lift; and the two-dot chain line indicates a timing of fuel pumping.

First, a function of the fuel injection pump driving cam 74 at a time of normal rotation (in the direction from left to right in FIG. 8) will be described. In a stage where the roller 42 abuts against the minimum radius portion 61, the fuel cam lift is at a minimum position, which is a position where the plunger 43 of the fuel injection pump 12 extends to the maximum (non-compression position). In a stage where the roller 42 abuts against the slant portion 62, the fuel is injected at a predetermined crank angle. More specifically, fuel pumping is started from the position of a point P1 on the two-dot chain line of FIG. 8, and the fuel is injected after the pumped fuel reaches a nozzle-opening valve pressure. That is, a timing of fuel injection is after the point P1 which is a timing of fuel pumping, and thus the timing of fuel pumping and the timing of fuel injection are different from each other.

Then, in a stage where the roller 42 abuts against the maximum radius portion 63, the fuel cam lift is at a maximum position, which is a position where the plunger 43 of the fuel injection pump 12 retracts to the maximum (compressed position). Then, in a stage where the roller 42 abuts against the intermediate portion 65, an open/close operation of the exhaust valve 32 is performed, and the intake valve 31 starts to open.

Then, in a stage where the roller 42 abuts against the slant portion 66, the intake valve 31 is opened to an extent corresponding to at least substantially half of the full open lift of the intake valve 31. In a stage where the roller 42 abuts against the upper portion 67, the intake valve 31 is in a substantially full-open state. In a stage where the roller 42 starts to abut against the minimum radius portion 61, the intake valve 31 is in a closed state.

In other words, the fuel injection pump driving cam 74 is formed such that the upper portion 67 is provided in a position where the intake valve 31 is in the substantially full-open state.

Next, a function of the fuel injection pump driving cam 74 at a time of reverse rotation (in the direction from right to left in FIG. 8) will be described. In a stage where the roller 42 abuts against the minimum radius portion 61, the plunger 43 of the fuel injection pump 12 extends to the maximum (non-compression position). In a stage where the roller 42 abuts against the slant portion 68, the fuel is injected at a predetermined crank angle. As shown in FIG. 8, a timing of fuel injection in reverse rotation is different from the timing of fuel injection in normal rotation. The timing of fuel injection in normal rotation and the timing of fuel injection in reverse rotation are different from each other in that the timing in reverse rotation is later than the timing in normal rotation relative to a point P2 of the timing of fuel pumping.

Simultaneously with this, in a stage where the roller 42 abuts against the slant portion 68, the intake valve 31 is in a sufficiently-opened state. Therefore, the injected fuel is discharged from the intake port 7*a*, and an amount of fuel necessary for combustion cannot be ensured in the cylinder 2*a*, so that no combustion occurs.

Effects of the diesel engine 1 will be described.

Use of the fuel injection pump driving cam 74 enables the diesel engine 1 to prevent a reverse rotation from continuing if the reverse rotation occurs during operation.

INDUSTRIAL APPLICABILITY

The present invention is applicable to various diesel engines, and in particular, effectively applicable to a single-cylinder diesel engine.

REFERENCE SIGNS LIST

1 diesel engine
5 crankshaft
12 fuel injection pump
13 cam shaft
14 fuel injection pump driving cam
51 minimum radius portion
52 slant portion
53 maximum radius portion
54 slant portion
55 intermediate portion
56 slant portion

The invention claimed is:

1. A diesel engine comprising:
a cam shaft configured to be driven by a crankshaft;
a fuel injection pump driving cam coupled to the cam shaft and configured to drive a fuel injection pump, the fuel injection pump driving cam comprising:
a maximum radius portion,
a minimum radius portion,
an intermediate portion having a constant radius that is smaller than that of the maximum radius portion and larger than that of the minimum radius portion, and
one or more slant portions, where a first slant portion is positioned between the intermediate portion and the minimum radius portion; and
an intake cam coupled to the cam shaft and configured to drive an intake valve, wherein:
in forward rotational operation with respect to a fuel injection pump, the fuel injection pump driving cam is formed such that a position where the intermediate portion shifts to the first slant portion begins after the intake valve is opened to an extent corresponding to at least half of a maximum lift of the intake valve.

2. The diesel engine according to claim 1, wherein:
the fuel injection pump driving cam has an upper portion having a constant radius that is smaller than that of the maximum radius portion and larger than that of the intermediate portion, and
the intermediate portion, the first slant portion, and the upper portion, are positioned sequentially along a reverse rotation direction.

3. The diesel engine according to claim 2, wherein:
the fuel injection pump comprises a roller that abuts the fuel injection pump driving cam;
in the forward rotational operation, the roller sequentially contacts the intermediate portion, the first slant portion, and the upper portion; and
the first slant portion is in direct contact with the upper portion and the intermediate portion.

4. The diesel engine according to claim 3, wherein the one or more slant portions further comprises a second slant portion positioned between the upper portion and the minimum radius portion.

5. The diesel engine according to claim 4, wherein, the fuel injection pump driving cam is positioned such that a position where the upper portion abuts the roller corresponds to a position of the intake valve being in a substantially full-open state.

6. The diesel engine according to claim 1, wherein:
the intermediate portion, the first slant portion, and the minimum radius portion are formed in sequence along a reverse rotation direction of the fuel injection pump driving cam; and
in the forward rotational operation with respect to a fuel injection pump, the fuel injection pump driving cam is formed such that a position where the intermediate portion shifts to the first slant portion corresponds to a position of the intake valve being in a substantially full-open state.

7. The diesel engine according to claim 6, wherein a substantially full-open state of the intake valve corresponds to the maximum lift of the intake valve.

8. The diesel engine according to claim 7, further comprising:

an exhaust valve coupled to the cam shaft and configured to drive the exhaust valve;

wherein in the forward rotational operation, the fuel injection pump driving cam is formed such that a position where the intermediate portion shifts to the first slant portion begins after the exhaust valve is in a completely closed state.

9. The diesel engine according to claim 1, further comprising:

an exhaust valve coupled to the cam shaft and configured to drive an exhaust valve;

wherein:

the intermediate portion of the fuel injection pump driving cam is formed such that the exhaust valve performs an open/close operation, and in the forward rotational operation with respect to the fuel injection pump, a position of shifting from the intermediate portion to the one or more slant portions, corresponds to the exhaust valve being in a completely-closed state.

10. The diesel engine according to claim 1, wherein in reverse rotational operation with respect to a fuel injection pump, the fuel injection pump driving cam is formed such that a position where a second slant portion abuts the fuel injection pump corresponds to an intake valve being in an open state such that injected fuel from the fuel injection pump is discharged through an intake port.

11. The diesel engine according to claim 10, wherein the one or more slant portions further comprises:

a third slant portion positioned between the minimum radius portion and the maximum radius portion; and a fourth slant portion positioned between the maximum radius portion and the intermediate portion.

* * * * *